US011067011B2

(12) United States Patent
Lucarelli et al.

(10) Patent No.: US 11,067,011 B2
(45) Date of Patent: Jul. 20, 2021

(54) TARGET COMPRESSOR RATIO AND BURNED GAS RATIO GENERATION IN DIESEL AIR CHARGING MULTIVARIABLE CONTROL

(71) Applicant: GM GLOBAL TECHNOLOGY OPERATIONS LLC, Detroit, MI (US)

(72) Inventors: Marco Clelio Lucarelli, Turin (IT); Vincenzo Alfieri, Turin (IT); Francesco Castorina, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/675,361

(22) Filed: Nov. 6, 2019

(65) Prior Publication Data

US 2021/0131364 A1 May 6, 2021

(51) Int. Cl.

| | |
|---|---|
| ***F02D 41/00*** | (2006.01) |
| ***F02M 26/02*** | (2016.01) |
| *F02D 41/18* | (2006.01) |
| *F02M 26/05* | (2016.01) |

(52) U.S. Cl.

CPC ..... *F02D 41/0007* (2013.01); *F02D 41/0072* (2013.01); *F02M 26/02* (2016.02); *F02D 41/0052* (2013.01); *F02D 41/18* (2013.01); *F02D 2200/0402* (2013.01); *F02D 2200/0406* (2013.01); *F02D 2200/0411* (2013.01); *F02M 26/05* (2016.02)

(58) Field of Classification Search

CPC ..... F02D 41/0007; F02D 41/0052; F02D 41/0072; F02D 2200/0406; F02D 2200/0411; F02M 26/02; F02M 26/03; F02M 26/04; F02M 26/05

USPC ..... 123/564; 701/108

See application file for complete search history.

(56) References Cited

U.S. PATENT DOCUMENTS

| | | | | |
|---|---|---|---|---|
| 6,279,551 | B1 * | 8/2001 | Iwano | F02B 37/18 123/564 |
| 8,276,378 | B2 | 10/2012 | Song et al. | |
| 8,640,679 | B2 | 2/2014 | Wang et al. | |
| 9,482,147 | B2 * | 11/2016 | Zhu | F02D 41/1445 |
| 10,167,788 | B2 | 1/2019 | Conte et al. | |
| 10,208,696 | B2 | 2/2019 | Wang et al. | |
| 10,253,704 | B2 | 4/2019 | Conte et al. | |
| 10,393,038 | B2 | 8/2019 | Wang et al. | |
| 2010/0175674 | A1 * | 7/2010 | Vennettilli | F02D 41/1454 123/703 |

(Continued)

FOREIGN PATENT DOCUMENTS

DE 202015005772 U1 11/2016

*Primary Examiner* — Erick R Solis

(74) *Attorney, Agent, or Firm* — Harness, Dickey & Pierce, P.L.C.

(57) ABSTRACT

A control module includes a dynamic target selection module configured to receive an intake manifold pressure setpoint and a measured intake manifold pressure, select between the intake manifold pressure setpoint and the measured intake manifold pressure, and output a selected intake manifold pressure setpoint based on the selection. A multivariable control module is configured to receive at least one target setpoint that is based on the selected intake manifold pressure setpoint and control operation of an air charging system of a vehicle based on the at least one target setpoint.

16 Claims, 5 Drawing Sheets

(56) References Cited

U.S. PATENT DOCUMENTS

| | | | | |
|---|---|---|---|---|
| 2011/0120428 | A1* | 5/2011 | Pasero | F02D 41/1458 123/564 |
| 2011/0132334 | A1* | 6/2011 | Lippa | F02D 41/0052 123/556 |
| 2014/0305415 | A1* | 10/2014 | Somhorst | F02D 41/3035 123/563 |
| 2016/0146130 | A1* | 5/2016 | Haskara | F02D 41/0072 701/108 |
| 2016/0146134 | A1 | 5/2016 | Wang et al. | |
| 2019/0316533 | A1 | 10/2019 | Conte et al. | |

* cited by examiner

TARGET COMPRESSOR RATIO AND BURNED GAS RATIO GENERATION IN DIESEL AIR CHARGING MULTIVARIABLE CONTROL

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to exhaust gas recirculation (EGR), and more particularly to generating target compressor and burned gas ratios for diesel air charging in EGR systems.

Various parameters of an internal combustion engine are controlled in accordance with desired outputs such as engine speed, engine load, output torque, emissions, etc. Controlled parameters include, but are not limited to, air flow, fuel flow, and intake and exhaust valve settings.

In some engine systems, boost air may be provided to the engine to provide an increased flow of air to the engine relative to a naturally aspirated intake system to increase the output of the engine. In some examples, an air charging system such as a turbocharging system uses pressure in an exhaust system of the engine to drive a compressor to provide the boost air to the engine. In other examples, a supercharger uses mechanical power from the engine to drive a compressor to provide the boost air. An engine system may include both a turbocharging system and a supercharger. Engine control methods control boost air in order to control the resulting combustion within the engine and the resulting output of the engine. In some examples, EGR is controlled to optimize air charging.

SUMMARY

A control module includes a dynamic target selection module configured to receive an intake manifold pressure setpoint and a measured intake manifold pressure, select between the intake manifold pressure setpoint and the measured intake manifold pressure, and output a selected intake manifold pressure setpoint based on the selection. A multivariable control module is configured to receive at least one target setpoint that is based on the selected intake manifold pressure setpoint and control operation of an air charging system of a vehicle based on the at least one target setpoint.

In other features, the dynamic target selection module is configured to output the selected intake manifold pressure setpoint based on a difference between the intake manifold pressure setpoint and the measured intake manifold pressure.

In other features, the dynamic target selection module is configured to output the selected intake manifold pressure setpoint further based on a comparison between the difference between the intake manifold pressure setpoint and the measured intake manifold pressure and a threshold.

In other features, a volumetric efficiency module is configured to generate a cylinder total mass flow rate target based on the selected intake manifold pressure setpoint.

In other features, the volumetric efficiency module is configured to generate the cylinder total mass flow rate target further based on a volumetric efficiency calibration map.

In other features, a static setpoint transformation module is configured to generate the at least one target setpoint based on the selected intake manifold pressure setpoint, an air mass flow rate setpoint, and a cylinder total mass flow rate target.

In other features, the at least one target setpoint includes a target compressor ratio setpoint and a target burned gas ratio setpoint.

In other features, the static setpoint transformation module is configured to calculate the target burned gas ratio setpoint based on the cylinder total mass flow rate target.

A method for controlling an air charging system of a vehicle includes receiving an intake manifold pressure setpoint and a measured intake manifold pressure, selecting between the intake manifold pressure setpoint and the measured intake manifold pressure, outputting a selected intake manifold pressure setpoint based on the selection, receiving at least one target setpoint that is based on the selected intake manifold pressure setpoint, and controlling operation of the air charging system based on the at least one target setpoint.

In other features, the method further includes outputting the selected intake manifold pressure setpoint based on a difference between the intake manifold pressure setpoint and the measured intake manifold pressure.

In other features, the method further includes outputting the selected intake manifold pressure setpoint further based on a comparison between (i) the difference between the intake manifold pressure setpoint and the measured intake manifold pressure and (ii) a threshold.

In other features, the method further includes generating a cylinder total mass flow rate target based on the selected intake manifold pressure setpoint.

In other features, the method further includes generating the cylinder total mass flow rate target further based on a volumetric efficiency calibration map.

In other features, the method further includes generating the at least one target setpoint based on the selected intake manifold pressure setpoint, an air mass flow rate setpoint, and a cylinder total mass flow rate target.

In other features, the at least one target setpoint includes a target compressor ratio setpoint and a target burned gas ratio setpoint.

In other features, the method further includes calculating the target burned gas ratio setpoint based on the cylinder total mass flow rate target.

A control module includes a dynamic target selection module configured to receive an intake manifold pressure setpoint and a measured intake manifold pressure, select between the intake manifold pressure setpoint and the measured intake manifold pressure, and output a selected intake manifold pressure setpoint based on the selection, a volumetric efficiency module configured to generate a cylinder total mass flow rate target based on the selected intake manifold pressure setpoint and a volumetric efficiency calibration map, a static setpoint transformation module configured to generate a target compressor ratio setpoint and a target burned gas ratio setpoint based on the selected intake manifold pressure setpoint, an air mass flow rate setpoint, and the cylinder total mass flow rate target, and a multivariable control module configured to control operation of an air charging system of a vehicle based on the target compressor ratio setpoint and the target burned gas ratio setpoint.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1:
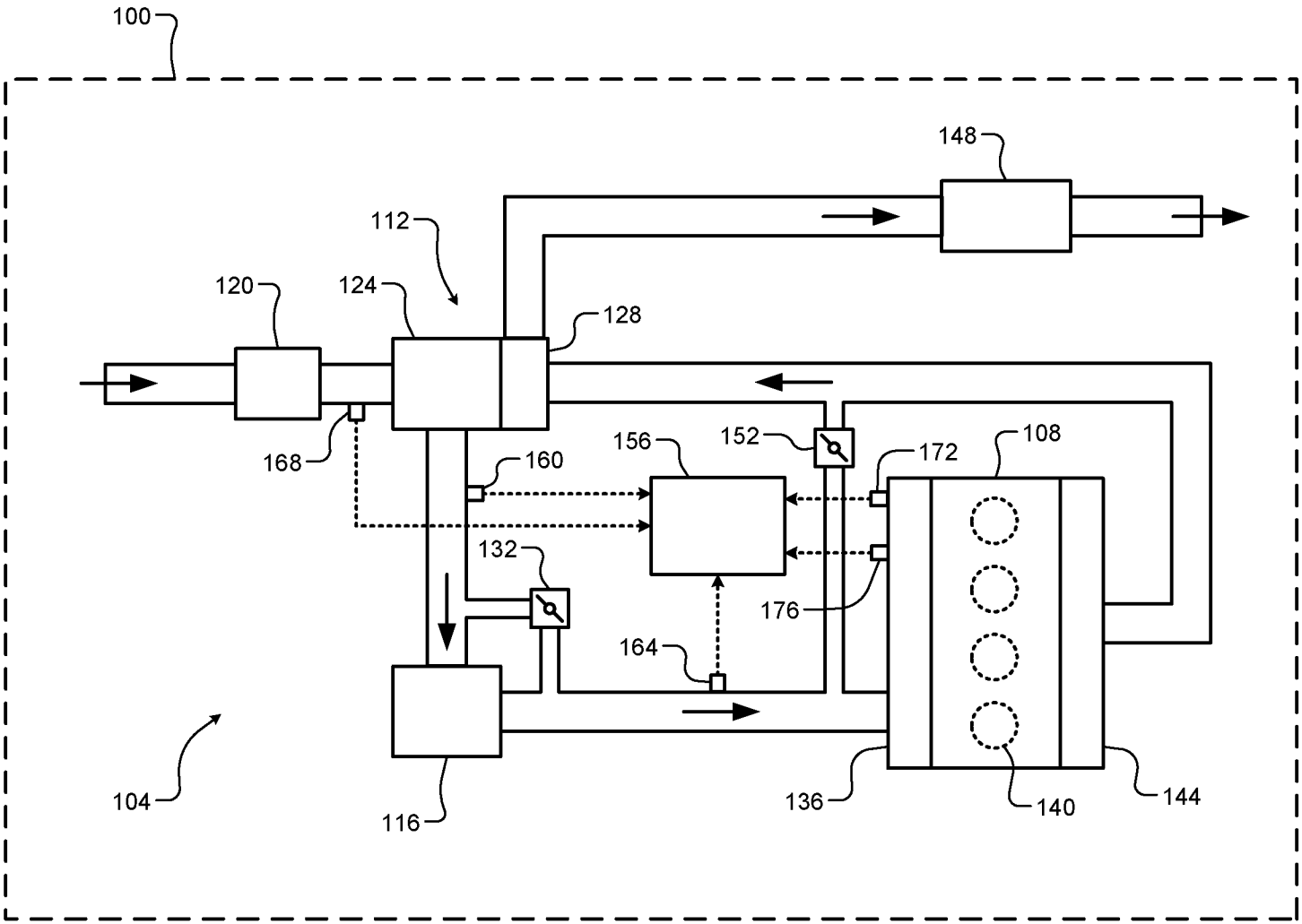
FIG. 1 is a functional block diagram of an example engine system.

Some engine control systems implement exhaust gas recirculation (EGR) to control combustion and engine output. For example, exhaust gas may be directed into an intake manifold of the engine to be recombusted. Air charging/handling systems manage the flow of intake air and EGR into the engine. The air charging systems are configured to operate in accordance with charge air composition targets (e.g., an EGR fraction target) to achieve emissions targets and total air available targets (e.g., a charge flow mass flow) to achieve desired power and torque targets. Generally, system actuators that significantly affect EGR flow may also affect charge flow while system actuators that significantly affect charge flow also affect EGR flow. Accordingly, air charging systems may correspond to a multiple input multiple output (MIMO) system with coupled input-output response loops.

MIMO systems such as air charging systems having coupled inputs (i.e., coupled input-output response loops) may operate over a wide range of parameters including, but not limited to, variable engine speeds, torque outputs, and fueling and timing schedules. In some examples, exact transfer functions and/or the computing power required for a standard decoupling calculation for the system are unavailable. Multi-route EGR control allows the system to run higher EGR rates at higher boost levels, but affects compressor flow and power.

Various calibrations and calculations corresponding to control of the air charging system may be inaccurate during transient periods, such as while shifting gears, resulting in poor control (e.g., early opening of an EGR valve). As an example, air charging systems may operate in accordance with inputs corresponding to various setpoints, which may correspond to desired performance parameters. For example, the setpoints may include, but are not limited to, an intake manifold pressure setpoint $\overline{p_{Boost}}$ and an air mass flow rate setpoint $\overline{W_{Air}}$.

The setpoints may be provided to a static setpoint transformation module configured to transform the setpoints into target setpoints for the air charging system (e.g., target setpoints of a multivariable control module of the air charging system). For example, the static setpoint transformation module may implement a transformation function to transform the input setpoints into the target setpoints. The transformation may correspond to an approximated transformation of the input setpoint to the target setpoints. Using the transformation function to generate the target setpoints, such as a burned gas ratio (BGR), based on the input setpoints may result in inaccurate control and degradation of drivability, such as the early opening of the EGR valve, increased smoke production, slow torque response, and/or increased NOx emissions.

In one example, the static setpoint transformation module outputs target setpoints including, but not limited to, a compressor pressure ratio setpoint $\overline{\beta_c}$, a burned gas ratio intake manifold setpoint $\overline{BGR_{Intk}}$, and a cylinder total mass flow rate target $\overline{W_{CylTot}}$. The compressor pressure ratio setpoint $\overline{\beta_c}$ may be calculated in accordance with $$\overline{\beta_c} = \frac{\overline{p_{Boost}}}{p_{ComprUp}},$$

where $p_{ComprUp}$ corresponds to a pressure upstream of the compressor. The burned gas ratio $\overline{BGR_{Intk}}$ may be calculated in accordance with $$\overline{BGR_{Intk}} = \frac{\overline{W_{CylTot}} - \overline{W_{Air}}}{\overline{W_{CylTot}}}\overline{BGR_{Exh}},$$

where $\overline{BGR_{Exh}}$ corresponds to a burned gas ratio exhaust manifold setpoint. The cylinder total mass flow rate target $\overline{W_{CylTot}}$ may be calculated in accordance with $$\overline{W_{CylTot}} = \overline{p_{Boost}}\frac{W_{CylTot}^{Actual}}{p_{Boost}^{Meas}},$$

where $W_{CylTot}^{Actual}$ corresponds to an actual (e.g., as calculated and/or measured) cylinder total mass flow rate and $p_{Boost}^{Meas}$ corresponds to a measured intake manifold pressure.

In some examples, air charging systems may implement one or more approaches to adjust (i.e., scale up or scale down) setpoints to compensate for control inaccuracies. For example, various setpoints may be compensated by a multiplier, offset, etc. using a lookup table or map-based approach. However, conventional table or map-based approaches require complex, time-consuming, and computational intensive calibration processes due to multiple dependencies between inputs and outputs of the multivariable control.

Air charging control systems and methods according to the principles of the present disclosure are configured to compensate target setpoints provided to the multivariable control module during transient periods.

Referring now to FIG. 1, a vehicle 100 includes an engine system 104 configured to control an engine 108 that combusts an air/fuel mixture to produce drive torque. The engine 108 may be a diesel, gasoline, or other type of combustion engine. The engine system 104 includes a turbocharger 112 and/or a supercharger 116. Air is provided to the engine 108 via an intake 120, which may include sensors (not shown) such as a mass airflow sensor.

A compressor 124 of the turbocharger 112 compresses the air provided to the engine 108. The turbocharger 112 may correspond to a variable geometry turbocharger (VGT) or other type of turbocharger. A turbine 128 of the turbocharger 112 controls flow, velocity, and/or pressure of the air within the compressor 124. Air output from the compressor 124 is provided to the supercharger 116. A bypass valve 132 may be actuated to selectively allow the compressed air to bypass the supercharger 116 to be directly provided to an intake manifold 136 of the engine 108.

The compressed air is combined with fuel within cylinders 140 of the engine 108 and combusted to produce drive torque. Although four of the cylinders 140 are shown, the engine 108 may include any suitable number of cylinders (e.g., between two and sixteen) arranged in various configurations. Exhaust gas exits the engine 108 via an exhaust manifold 144 and is input to the turbine 128 prior to being exhausted from the vehicle 100 through one or more exhaust treatment devices. In some examples, an EGR valve 152 may be selectively opened and closed to mix the exhaust gas with the compressed air provided to the intake manifold 136.

A control module (e.g., an engine control module) 156 controls components of the engine system 104 (e.g., such as the turbocharger 112) and actuators including, but not limited to, the bypass valve 132 and the EGR valve 152 based on inputs such as sensed or measured data, modeled data, vehicle inputs (e.g., performance requests and/or setpoints), etc.

For example, a pressure sensor 160 senses a pressure of air provided from the turbocharger 112 and provides a first pressure signal to the control module 156 accordingly. Similarly, a pressure sensor 164 senses a pressure of air provided from the supercharger 116 and provides a second pressure signal to the control module 156 accordingly. An air temperature sensor 168 senses a temperature of air entering the engine system 104 and provides an intake air temperature signal to the control module 156 accordingly. A coolant temperature sensor 172 senses a temperature of coolant fluid in the engine 108 and provides a coolant temperature signal to the control module 156 accordingly. An engine speed sensor 176 senses a rotational speed of the engine 108 and provides an engine speed signal to the control module 156 accordingly.

The control module 156 controls the engine system 104 (including multivariable control of an air charging system) according to the received signals and/or other inputs. One example configuration of the control module 156 is described in more detail in U.S. patent application Ser. No. 15/953,854, filed on Apr. 16, 2018, the entire disclosure of which is incorporated herein by reference. The control module 156 according to the principles of the present disclosure is further configured to improve accuracy of compressor pressure ratio and burned gas ratio setpoints to as described below in more detail.

Figure 2:
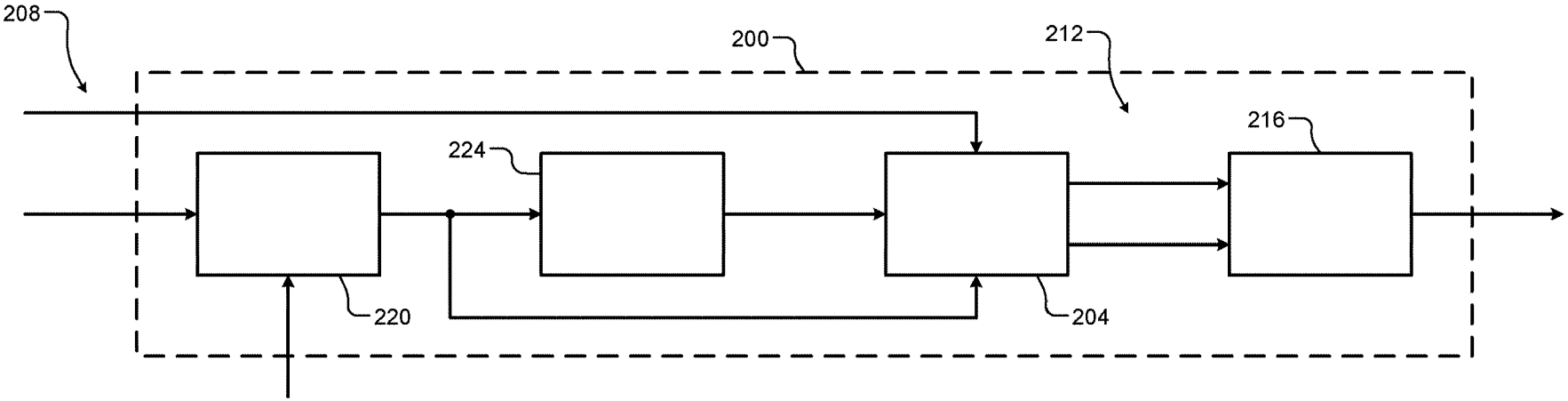
FIG. 2 is a functional block diagram of an example control module.

An example control module 200 (e.g., corresponding to the control module 156) is described in more detail in FIG. 2. The control module 200 includes a static setpoint transformation module 204 configured to transform setpoints 208 into target setpoints 212 for the air charging system (e.g., target setpoints of a multivariable control module 216 of the air charging system). For example, the static setpoint transformation module 204 may implement a transformation function to transform the input setpoints 208 into the target setpoints 212. For example only, the input setpoints 208 include, but are not limited to, an intake manifold pressure setpoint $\overline{p_{Boost}}$ and an air mass flow rate setpoint $\overline{W_{Air}}$ and the target setpoints 212 include, but are not limited to, a compressor pressure ratio setpoint $\overline{\beta_c}$ and a burned gas ratio $\overline{BGR_{Intk}}$.

The control module 200 according to the principles of the present disclosure further includes a dynamic target selection (DTS) module 220 and a volumetric efficiency module 224. For example only, the static setpoint transformation module 204 receives the air mass flow rate setpoint $\overline{W_{Air}}$ and the DTS module 220 receives the intake manifold pressure setpoint Boost and a measured intake manifold pressure $p_{Boost}^{Meas}$. The DTS module 220 selectively outputs, as an intake manifold pressure setpoint, a selected intake manifold pressure setpoint $p_{Boost}^{Selected}$ (e.g., corresponding to a selected boost pressure) either the intake manifold pressure setpoint $\overline{p_{Boost}}$ or the measured intake manifold pressure $p_{Boost}^{Meas}$. For example, the DTS module 220 selects between the intake manifold pressure setpoint $\overline{p_{Boost}}$ and the measured intake manifold pressure $p_{Boost}^{Meas}$ in accordance with $$p_{Boost}^{Selected} = \begin{cases} P_{Boost}^{Meas} & \text{if } (\overline{p_{Boost}} - p_{Boost}^{Meas}) > K_{BoostDevThr}^{*} \\ \overline{P_{Boost}} & \text{if } (\overline{p_{Boost}} - p_{Boost}^{Meas}) < K_{BoostDevThr}^{*} \end{cases},$$

where $K_{BoostDevThr}^{*}$ is an adjustable constant corresponding to a boost deviation calibration threshold.

The boost deviation calibration threshold corresponds to calibratable transition logic for selecting an actual boost pressure value (i.e., the measured intake manifold pressure) instead of the intake manifold pressure setpoint based on a selected value of $K_{BoostDevThr}^{*}$. In other words, if a difference between the intake manifold pressure setpoint $\overline{p_{Boost}}$ and the measured intake manifold pressure $p_{Boost}^{Meas}$ is greater than $K_{BoostDevThr}^{*}$, the DTS module 220 selects and outputs the measured intake manifold pressure $p_{Boost}^{Meas}$. Conversely, if the difference between the intake manifold pressure setpoint $\overline{p_{Boost}}$ and the measured intake manifold pressure $p_{Boost}^{Meas}$ is less than $K_{BoostDevThr}^{*}$, the DTS module 220 selects and outputs the intake manifold pressure setpoint $p_{Boost}$. In this manner, the actual measured intake manifold pressure $p_{Boost}^{Meas}$ is used as the selected intake manifold pressure setpoint $p_{Boost}^{Selected}$ until the actual measured intake manifold pressure $p_{Boost}^{Meas}$ is within a ost threshold distance (as defined by $K_{BoostDevThr}^{*}$) of the commanded intake manifold pressure setpoint $\overline{p_{Boost}}$. Hysteresis logic may be implemented to avoid toggling between the intake manifold pressure setpoint $\overline{p_{Boost}}$ and the measured intake manifold pressure $p_{Boost}^{Meas}$.

The selected intake manifold pressure setpoint $p_{Boost}^{Selected}$ output from the DTS module 220 is provided to the volumetric efficiency module 224. The volumetric efficiency module 224 is configured to implement a volumetric efficiency model to calculate a compensated cylinder total mass flow rate target $\overline{W_{CylTot}^{New}}$ based on the selected intake manifold pressure setpoint $p_{Boost}^{Selected}$. For example, the volumetric efficiency module 224 calculates the compensated cylinder total mass flow rate target $\overline{W_{CylTot}^{New}}$ in accordance with $$\overline{W_{CylTot}^{New}} = \eta_{v0} \frac{V_d n_{Eng}}{120\ RT_i} p_{Boost}^{Selected},$$

where $\eta_{v0}$ corresponds to a volumetric efficiency calibration map, $V_d$ is engine displacement volume, $n_{Eng}$ is engine speed, R is the universal gas constant, and $T_i$ is an intake manifold gas temperature.

The static setpoint transformation module 204 calculates compensated target setpoints (e.g., target compressor pressure ratio $\overline{\beta_c}$ and burned gas ratio $\overline{BGR_{Intk}}$ setpoints) based on the air mass flow rate setpoint $\overline{W_{Air}}$, the selected intake manifold pressure setpoint $p_{Boost}^{Selected}$, and the compensated cylinder total mass flow rate target $\overline{W_{CylTot}^{New}}$. For example, the static setpoint transformation module 204 calculates the compensated target burned gas ratio setpoint $\overline{BGR_{Intk}}$ in accordance with $$\overline{BGR_{Intk}} = \frac{\overline{W_{CylTot}^{New}} - \overline{W_{Air}}}{\overline{W_{CylTot}^{New}}} \overline{BGR_{Exh}}.$$

In this manner, compensated target setpoints calculated in accordance with the principles of the present disclosure are provided to the multivariable control module 216.

Figure 3A:
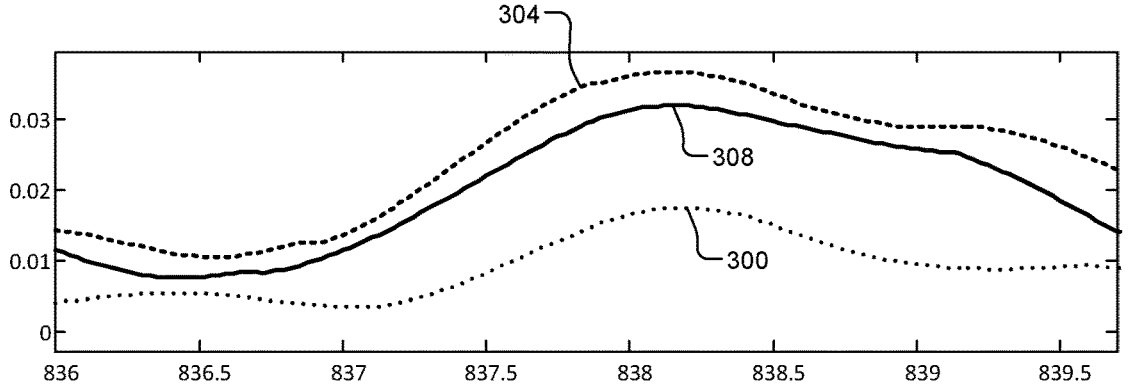
FIGS. 3A, 3B, and 3C illustrate results of example calibrations of dynamic target selection logic.
Figure 3B:
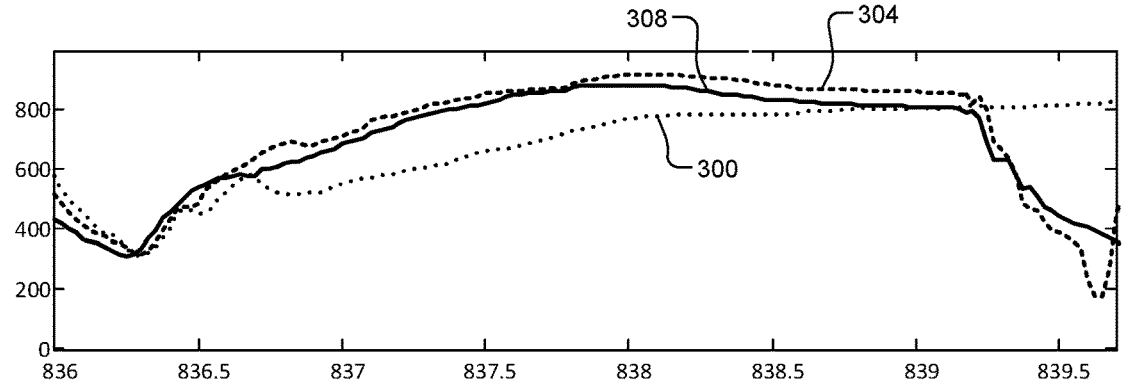
Figure 3C:
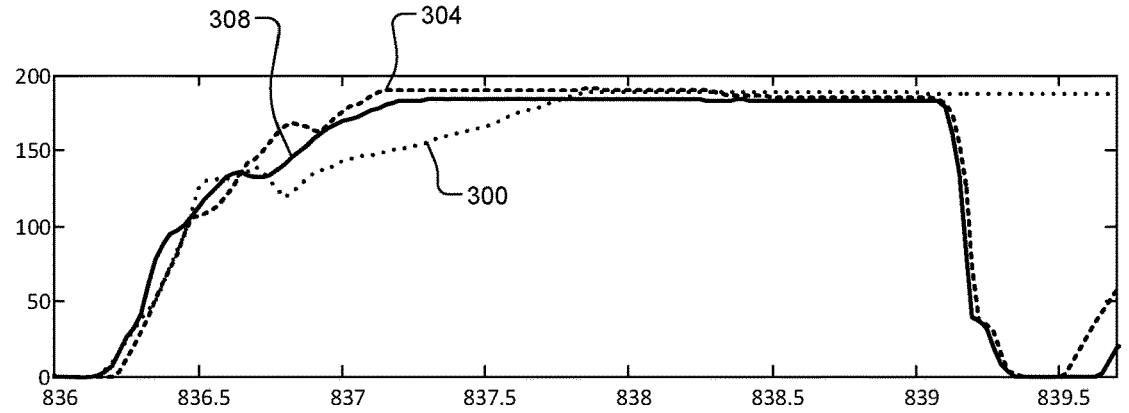

FIGS. 3A, 3B, and 3C illustrate results of example calibrations of dynamic target selection logic corresponding to different target burned gas ratio setpoints $\overline{BGR_{Intk}}$ (e.g., based on the compensated cylinder total mass flow rate target $\overline{W_{CylTot}^{New}}$ as calculated using the volumetric efficiency calibration map $\eta_{v0}$) during a transient period. For example, different calibrations may be achieved by adjusting a boost deviation calibration threshold $K_{BoostDevThr}$* based on desired results. FIG. 3A illustrates NOx emissions for three different calibrations: a first calibration 300 configured to minimize NOx emission; a second calibration 304 configured to minimize soot output; and a third calibration 308 configured to trade off (i.e., balance) between minimizing NOx emission and soot output. For example, the third calibration 308 results in greater NOx emission than the first calibration 300 but less NOx emission than the second calibration 304.

FIGS. 3B and 3C illustrate air flow and immediate torque, respectively, for the first calibration 300, the second calibration 304, and the third calibration 308. For example, as shown in FIG. 3B, the first calibration 300 results in a slow and uneven increase in air flow relative to the second calibration 304. Consequently, immediate torque for the first calibration 300 is reduced by as much as 40 Nm (e.g., 21%) relative to the second calibration 304. Conversely, air flow for the third calibration 308 is similar to the second calibration 304 and results in a reduction in immediate torque of only 8 Nm (e.g., 4%).

Figure 4:
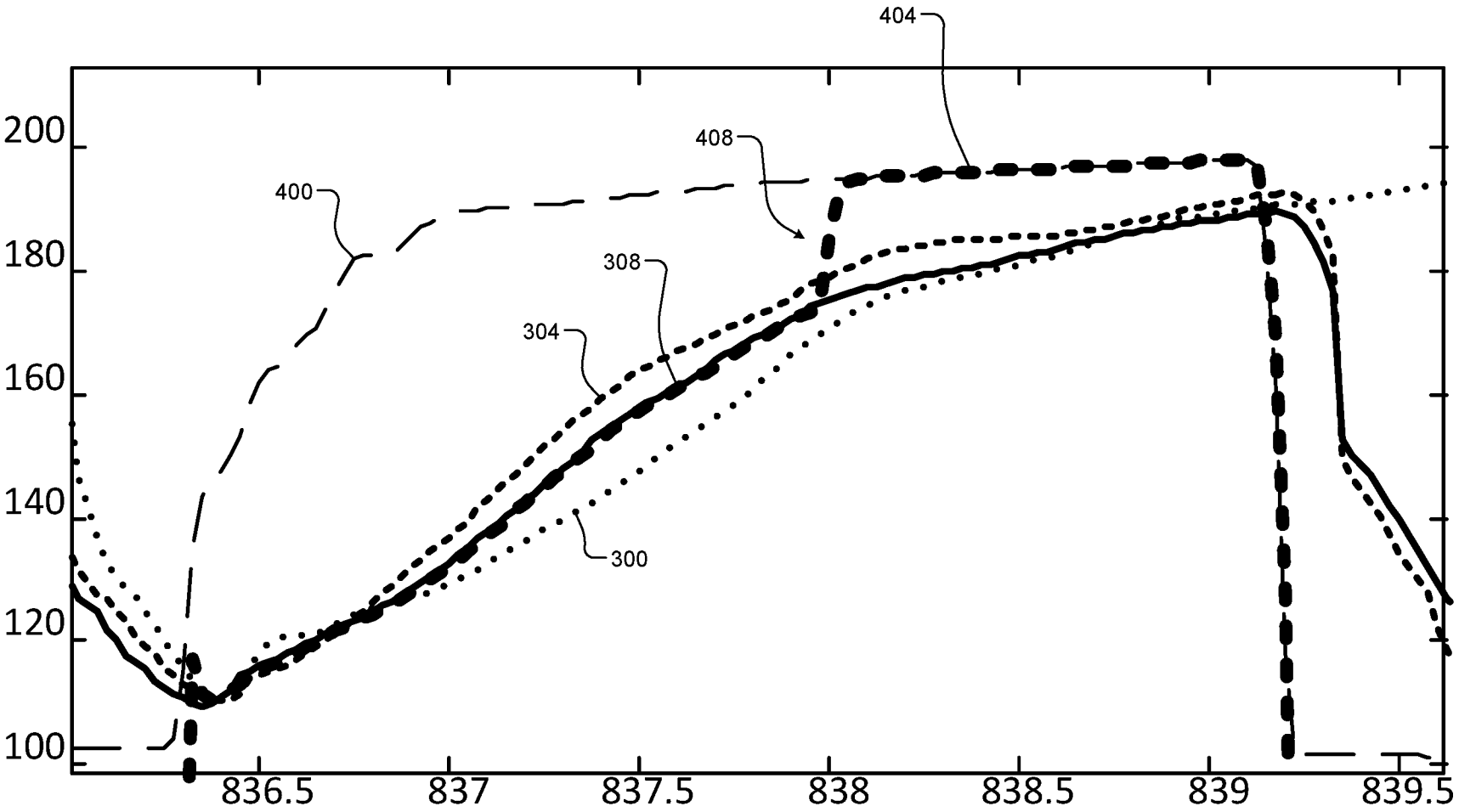
FIG. 4 is an example illustration of selected boost pressure output for respective calibrations.

FIG. 4 illustrates example boost pressure responses and selected boost pressure outputs of the DTS module 220 corresponding to the first calibration 300, the second calibration 304, and the third calibration 308. An example boost pressure response corresponding to the commanded intake manifold pressure setpoint $\overline{p_{Boost}}$ is shown at 400. A boost pressure response corresponding to the selected intake manifold pressure setpoint $p_{Boost}^{Selected}$ is shown at 404. As described above, the selected intake manifold pressure setpoint $p_{Boost}^{Selected}$ corresponds to the actual measured intake manifold pressure $p_{Boost}^{Meas}$ (in accordance with, for example, the third calibration 308) until the actual measured intake manifold pressure $p_{Boost}^{Meas}$ is within the threshold distance $K_{BoostDevThr}$* of the commanded intake manifold pressure setpoint $\overline{p_{Boost}}$ as shown at 408. Accordingly, at 408, the boost pressure response of the selected intake manifold pressure setpoint $p_{Boost}^{Selected}$ 404 increases sharply to match the boost pressure response corresponding to the commanded intake manifold pressure setpoint $\overline{p_{Boost}}$ 400.

Figure 5:
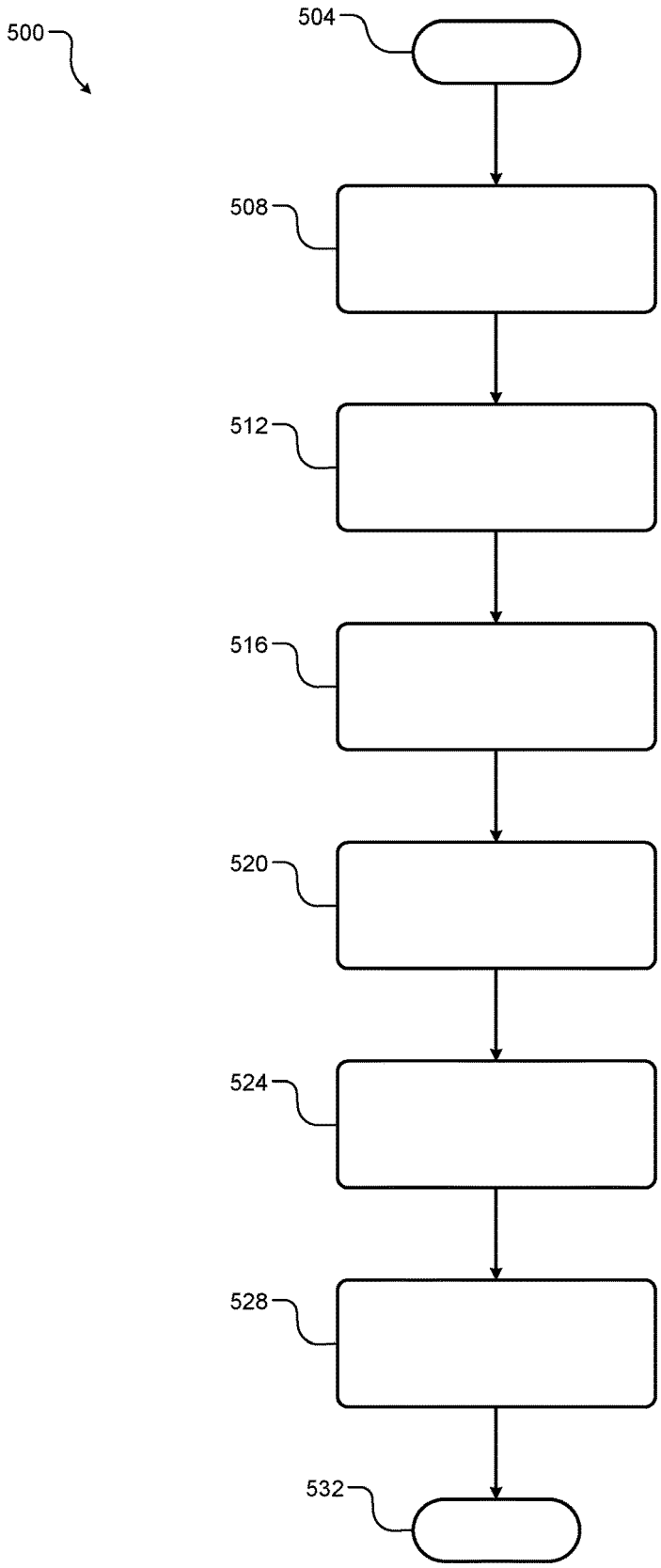
FIG. 5 illustrates steps of an example method for generating a target intake manifold pressure setpoint.

Referring now to FIG. 5, an example method 500 for generating a target intake manifold pressure setpoint according to the present disclosure begins at 504. At 508, the method 500 determines calibrated values corresponding to setpoint calculation. For example, the calibrated values may include, but are not limited to, the volumetric efficiency calibration map $\eta_{v0}$ and the threshold distance $K_{BoostDevThr}$*. The calibrated values may be determined in accordance with desired NOx emission and soot levels and torque response as described above.

At 512, the method 500 (e.g., the control module 200) receives one or more commanded setpoints (e.g., the intake manifold pressure setpoint $\overline{p_{Boost}}$ and the air mass flow rate setpoint $\overline{W_{Air}}$) and the measured intake manifold pressure $p_{Boost}^{Meas}$. At 516, the method 500 (e.g., the DTS module 220) selects between the intake manifold pressure setpoint $\overline{p_{Boost}}$ and the measured intake manifold pressure $p_{Boost}^{Meas}$ based on the threshold distance $K_{BoostDevThr}$* and outputs the selected intake manifold pressure setpoint $p_{Boost}^{Selected}$ accordingly.

At 520, the method 500 (e.g., the volumetric efficiency module 224) calculates the compensated cylinder total mass flow rate target $\overline{W_{CylTot}^{New}}$ based on the selected intake manifold pressure setpoint $p_{Boost}^{Selected}$. At 524, the method 500 (e.g., the static setpoint transformation module 204) calculates the target setpoints including the compressor pressure ratio setpoint $\overline{\beta_c}$ and the burned gas ratio $\overline{BGR_{Intk}}$ setpoint based on the compensated cylinder total mass flow rate target $W_{CylTot}^{New}$, the selected intake manifold pressure setpoint $p_{Boost}^{Selected}$, and the air mass flow rate setpoint $\overline{W_{Air}}$.

At 528, the method 500 (e.g., the multivariable control module 216) controls The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. A control module, comprising:

a dynamic target selection module configured to (i) receive an intake manifold pressure setpoint and a measured intake manifold pressure, (ii) determine a difference between the intake manifold pressure setpoint and the measured intake manifold pressure, (iii) select between the intake manifold pressure setpoint and the measured intake manifold pressure based on a comparison between the determined difference and a threshold, and (iv) output a selected one of the intake manifold pressure setpoint and the measured intake manifold pressure as a selected intake manifold pressure setpoint based on the selection; and a multivariable control module configured to (i) receive at least one target setpoint that is based on the selected intake manifold pressure setpoint and (ii) control operation of an air charging system of a vehicle based on the at least one target setpoint.

2. The control module of claim 1, further comprising a volumetric efficiency module configured to generate a cylinder total mass flow rate target based on the selected intake manifold pressure setpoint.

3. The control module of claim 2, wherein the volumetric efficiency module is configured to generate the cylinder total mass flow rate target further based on a volumetric efficiency calibration map.

4. The control module of claim 1, further comprising a static setpoint transformation module configured to generate the at least one target setpoint based on the selected intake manifold pressure setpoint, an air mass flow rate setpoint, and a cylinder total mass flow rate target.

5. The control module of claim 4, wherein the at least one target setpoint includes a target compressor ratio setpoint and a target burned gas ratio setpoint.

6. The control module of claim 5, wherein the static setpoint transformation module is configured to calculate the target burned gas ratio setpoint based on the cylinder total mass flow rate target.

7. A method for controlling an air charging system of a vehicle, the method comprising:

receiving an intake manifold pressure setpoint and a measured intake manifold pressure;

determining a difference between the intake manifold pressure setpoint and the measured intake manifold pressure, selecting between the intake manifold pressure setpoint and the measured intake manifold pressure based on a comparison between the determined difference and a threshold;

outputting a selected one of the intake manifold pressure setpoint and the measured intake manifold pressure as a selected intake manifold pressure setpoint based on the selection;

receiving at least one target setpoint that is based on the selected intake manifold pressure setpoint; and controlling operation of the air charging system based on the at least one target setpoint.

8. The method of claim 7, further comprising generating a cylinder total mass flow rate target based on the selected intake manifold pressure setpoint.

9. The method of claim 8, further comprising generating the cylinder total mass flow rate target further based on a volumetric efficiency calibration map.

10. The method of claim 7, further comprising generating the at least one target setpoint based on the selected intake manifold pressure setpoint, an air mass flow rate setpoint, and a cylinder total mass flow rate target.

11. The method of claim 10, wherein the at least one target setpoint includes a target compressor ratio setpoint and a target burned gas ratio setpoint.

12. The method of claim 11, further comprising calculating the target burned gas ratio setpoint based on the cylinder total mass flow rate target.

13. A control module, comprising:

a dynamic target selection module configured to (i) receive an intake manifold pressure setpoint and a measured intake manifold pressure, (ii) determine a difference between the intake manifold pressure setpoint and the measured intake manifold pressure, (iii) select between the intake manifold pressure setpoint and the measured intake manifold pressure based on a comparison between the determined difference and a threshold, and (iv) output a selected one of the intake manifold pressure setpoint and the measured intake manifold pressure as a selected intake manifold pressure setpoint based on the selection;

a volumetric efficiency module configured to generate a cylinder total mass flow rate target based on the selected intake manifold pressure setpoint and a volumetric efficiency calibration map;

a static setpoint transformation module configured to generate a target compressor ratio setpoint and a target burned gas ratio setpoint based on the selected intake manifold pressure setpoint, an air mass flow rate setpoint, and the cylinder total mass flow rate target; and a multivariable control module configured to control operation of an air charging system of a vehicle based on the target compressor ratio setpoint and the target burned gas ratio setpoint.

14. The control module of claim 1, wherein the dynamic target selection module is configured to output the measured intake manifold pressure as the selected intake manifold pressure setpoint in response to a determination that the difference between the intake manifold pressure setpoint and the measured intake manifold pressure is greater than the threshold.

15. The method of claim 7, further comprising outputting the measured intake manifold pressure as the selected intake manifold pressure setpoint in response to a determination that the difference between the intake manifold pressure setpoint and the measured intake manifold pressure is greater than the threshold.

16. The control module of claim 13, wherein the dynamic target selection module is configured to output the measured intake manifold pressure as the selected intake manifold pressure setpoint in response to a determination that the difference between the intake manifold pressure setpoint and the measured intake manifold pressure is greater than the threshold.

* * * * *